US005201209A

United States Patent [19]

Houmura et al.

[11] Patent Number: 5,201,209

[45] Date of Patent: Apr. 13, 1993

[54] PULLER APPARATUS FOR AN EXTRUSION MACHINE

[75] Inventors: Masao Houmura, Kanazawa; Mitsuo Yasui, Matsutou; Seizo Washizuka, Takaoka; Norio Futakuchi, Shinminato; Hitoshi Mukaiyama, Toyama, all of Japan

[73] Assignee: Giken Kabushiki Kaisha, Nonoichimachi, Japan

[21] Appl. No.: 743,868

[22] Filed: Aug. 12, 1991

[30] Foreign Application Priority Data

Aug. 13, 1990 [JP] Japan ..... 2-214600

[51] Int. Cl.[5] ..... B21C 35/02

[52] U.S. Cl. ..... 72/257

[58] Field of Search ..... 72/255, 257

[56] References Cited

U.S. PATENT DOCUMENTS 3,668,910 6/1972 Gentry et al. .

FOREIGN PATENT DOCUMENTS

| | | | |
|---|---|---|---|
| 212213 | 12/1960 | Australia . | |
| 0291734 | 11/1988 | European Pat. Off. . | |
| 1299589 | 7/1969 | Fed. Rep. of Germany . | |
| 3040236 | 5/1982 | Fed. Rep. of Germany | 72/257 |
| 3917002 | 5/1990 | Fed. Rep. of Germany . | |
| 1306692 | 9/1962 | France . | |
| 55-7284 | 2/1980 | Japan . | |
| 59-22883 | 7/1984 | Japan . | |

*Primary Examiner*—Lowell A. Larson

*Attorney, Agent, or Firm*—Morrison Law Firm

[57] ABSTRACT

Apparatus for pulling metal extruded from an extrusion machine has a pair of carriers mounted on one side and below the surface of a runout table. Each carrier moves on a rail parallel to the table. One carrier in an operative position does not interfere with the other in a retracted position when they pass each other. Production efficiency is improved by using the carriers alternately. With the rails below the level of the table surface, space above the runout table can accommodate apparatus to cool the extruded metal.

7 Claims, 8 Drawing Sheets

PULLER APPARATUS FOR AN EXTRUSION MACHINE

BACKGROUND ART

The present invention relates to a puller apparatus installed behind a metal extrusion press.

In order to prevent bending or torsion of an extruded metal which is formed by the metal extrusion press, a puller apparatus is typically provided behind a metal extrusion press (hereinafter simply referred to as an extrusion machine) to pull such an extruded metal by a constant tractional force.

A conventional puller apparatus includes one carrier per extrusion machine. When an extruded metal is conveyed onto a runout table, the carrier can clamp the front end of the extruded metal and pull it in a forward direction. A recent extrusion machine provides two carriers for improving extrusion speed, and using a longer runout table to convey a very long extruded metal. To this end, the two carriers are alternately operated to reduce the rest time of the extrusion machine.

Such a puller apparatus typically includes a pair of guide rails mounted on one side of a runout table, and subrails are employed to connect opposite ends of the guide rails. Two carriers are alternately moved around and on the guide rails (Japanese utility model publication No. 55-7284). Another known puller apparatus includes a pair of guide rails above a runout table. Carriers are hung on the guide rails. Only clamps of the carriers are alternately moved to its operative position on the runout table (Japanese utility model publication No. 59-22883).

In the former prior art, since the opposite ends of guide rails are connected through the subrails, the carriers must be moved from one of the guide rails to the other rail via the subrails. The carriers are moved in two different directions on the guide rails and subrails, so that they do not complicate the drive system. Also, the carrier has to be advanced to its foremost position where the subrail is provided independent of the length of a metal to be extruded. This results in loss of time during an operation cycle.

A disadvantage of the latter prior art is that the guide rails interface with the view above the runout table for operating the puller apparatus. And a space must be available on the runout table to enable movement of the carriers, but this arrangement prevents installation of a cooling fan adapted to cool an extruded metal.

OBJECT OF THE INVENTION

In view of the foregoing, it is an object of this invention to provide a puller apparatus for an extrusion machine which enables provision of a simple drive system adapted to drive carriers, which minimizes the required movement of the carriers in accordance of the length of an extruded metal, and which provides a full open space above a runout table.

DETAILED DESCRIPTION OF THE INVENTION

Figure 1:
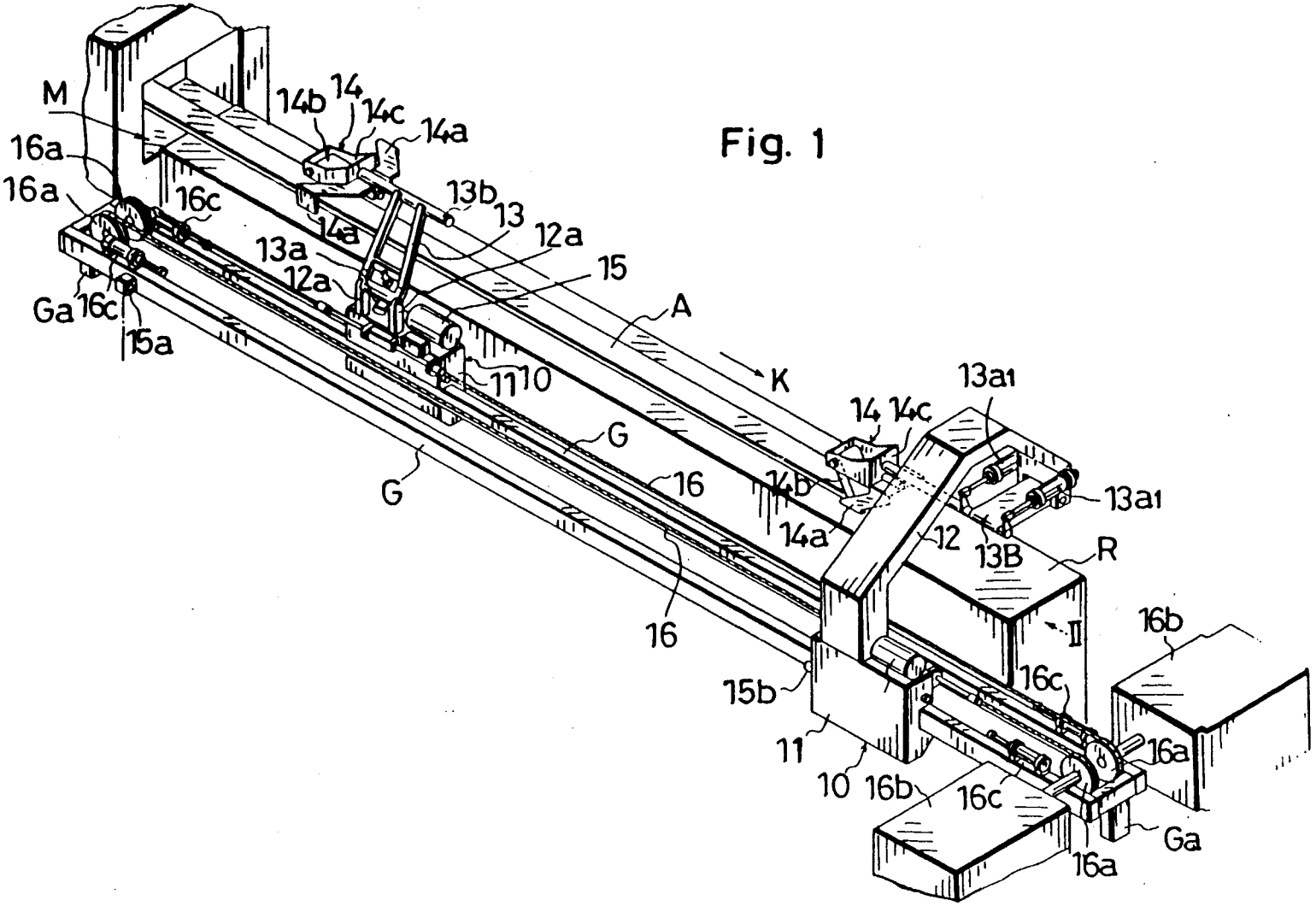
FIG. 1 is a perspective view showing the overall structure of a puller apparatus according to one embodiment of the present invention.

As shown in FIG. 1, a puller apparatus for an extrusion machine includes runout table R, a pair of guide rails G, G mounted on one side of the runout table R, and a pair of corresponding carriers 10, 10 are provided on the guide rails G,G.

The runout table R is elongated and located behind an extrusion machine M. An extruded metal A is fed from the extrusion machine M and received on the runout table R. The supplying base end of the extruded metal A is cut by a cutter (not shown). A piece of the extruded metal A thus cut is first dropped onto the runout table R and then, delivered to the other side of the runout table R.

Figure 2:
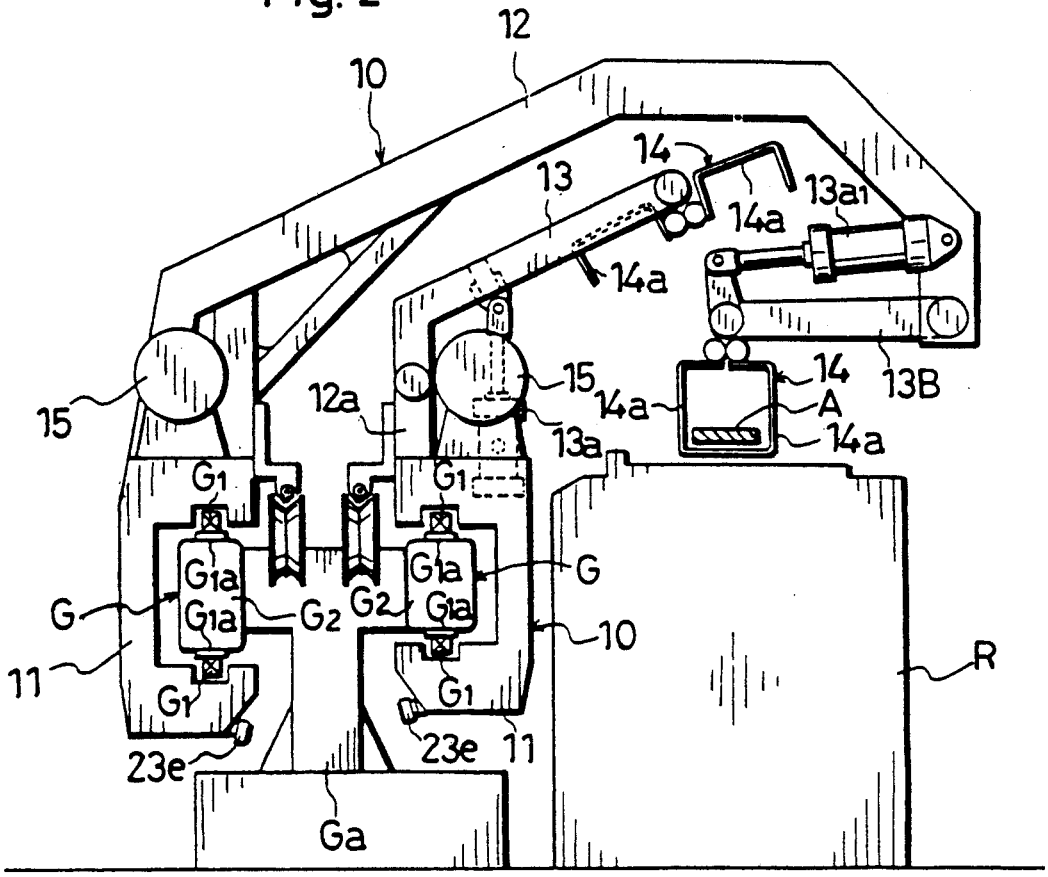
FIG. 2 is a side view of the puller apparatus as seen in the direction of the arrow II in FIG. 1.

The guide rails G, G are supported on suitable bases Ga, Ga and extend in parallel to the runout table R. As shown in FIG. 2, each guide rail G includes an elongated structural element G2, and a pair of rail bodies G1, G1 attached to the structural element G2 through a pair of corresponding spacers G1a, G1a.

The carriers 10, 10 are movable on the guide rails G, G.

Figure 3:
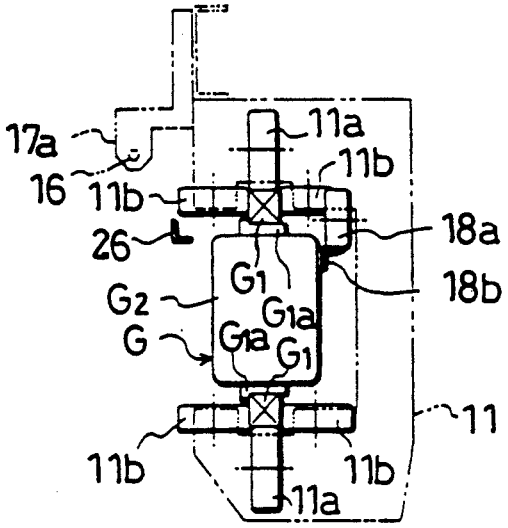
FIG. 3 is an enlarged view showing the principal part of the apparatus shown in FIG. 2.

The carrier 10 movable on the guide rail G closer to the runout table R comprises a movable frame 11, a pair of rod-link supports 12*a*, 12*a*, a swing base 13 pivotably mounted to the front end of the supports 12*a*, 12*a*, and a clamp head 14 attached to the end of swing base 13. As shown in FIG. 3, the movable frame 11 is movably supported by the rail bodies G1, G1 through vertical rollers 11*a* and horizontal rollers 11*b*, 11*b*. An air tank 16 is placed on the movable frame 11 (FIGS. 1 and 2). The swing base 13 is vertically swingable relative to the movable frame 11 by means of an air cylinder 13*a*.

Figure 4A:
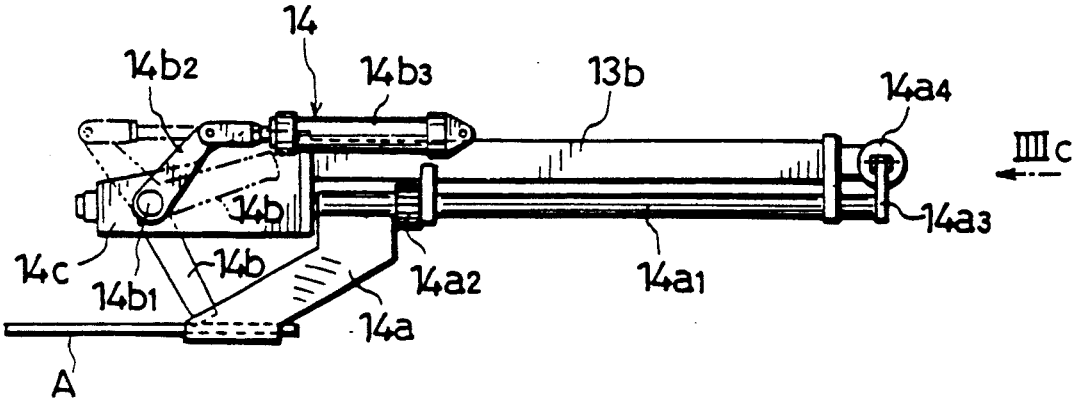
FIG. 4A is a side view of a clamp head shown in FIG. 1.
Figure 4B:
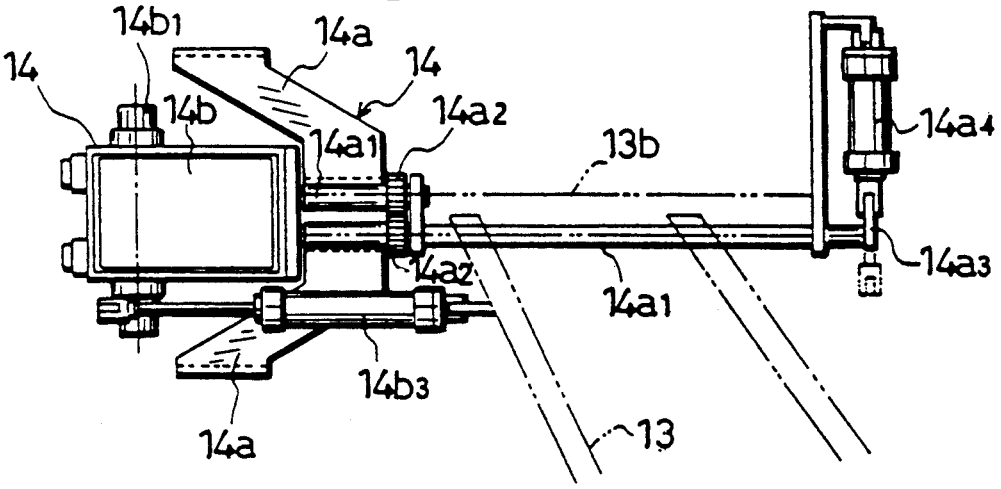
FIG. 4B is a plan view of the clamp head shown in FIG. 4A.
Figure 4C:
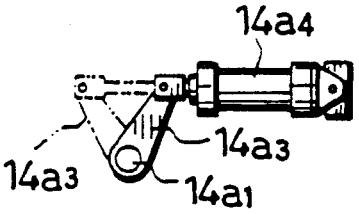
FIG. 4C is a view of the clamp head as seen in the direction of the arrow IIIIC in FIG. 4A.

The clamp head 14 is mounted through a support rod 13*b* to the front ends of the swing base 13 and generally horizontally extends in a rearward direction (toward the extrusion machine M; see FIG. 1. A forward direction is shown by the arrow K in FIG. 1. A rearward direction is a direction opposite to the forward direction. As shown in FIGS. 4A and 4B, the clamp head 14 includes a pair of right and left jaws 14*a*, 14*a*, a finger 14*b*, and a frame 14*c* designed to contain the finger 14*b*.

The jaws 14*a*, 14*a* are pivotable about a pair of pivot pins 14*a*1, 14*a*1 below the frame 14*c*. A pair of corresponding gears 14a2, 14a2 are mounted on the pivot pins 14a1, 14a1 and engaged with one another. One of the pivot pins 14a1 extends forwardly from the gear 14a2 and has a front end connected to an air cylinder 14a4 through an arm 14a3. Upon contraction of the air cylinder 14a4, the jaws 14a, 14a are opened to their horizontal position (FIG. 4B). When the air cylinder 14a4 is extended, the jaws 14a, 14a are pivoted downwardly and closed to form a box (FIG. 4B).

The finger 14b is mounted to the frame 14c and pivotable about a pivot pin 14b1. An arm extends from one end of the pivot pin 14b1 and has a front end connected to an air cylinder 14b3. Contraction of the air cylinder 14b3 causes the finger 14b to pivot downwards (shown by a solid line in FIG. 4A), whereas extension of the air cylinder 14b3 causes the finger 14b to pivot upwards (shown by a broken line in FIG. 4A).

When the jaws 14a, 14a are closed, and the finger 14b is pivoted downwards, they cooperate to clamp the front end of the extruded metal A. The extruded metal A is unclamped when the finger 14b is pivoted upwards, and the jaws 14a, 14a are opened.

The carrier 10 mounted on the guide rail G remote from the runout table R is essentially identical in structure to the other carrier 10 (FIGS. 1 and 2) except that a support 12 is a single elongate arm extending over the other carrier 10. A swing base 13b is mounted to the inner side of the arm 12 and is vertically swingable by means of a pair of air cylinders 1Sa1, 1Sa1.

Figure 5:
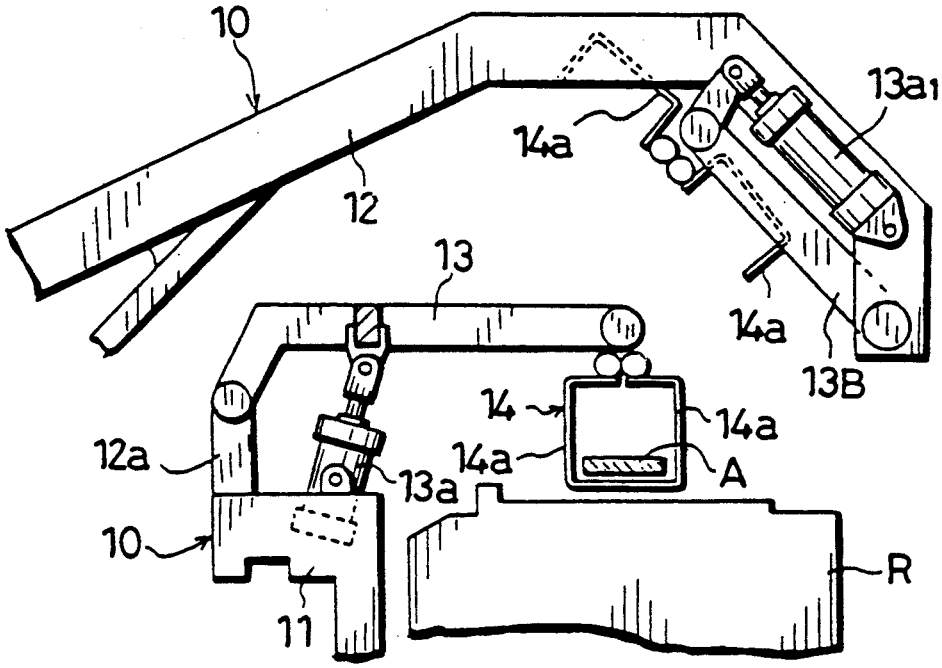
FIG. 5 is an enlarged view showing the principal part of the puller system in FIG. 1.

As shown in FIGS. 2 and 5, the carriers 10, 10 are positioned relative to one another so as not to interfere with one another. When the swing base 13 or 13b is pivoted upwards and the jaws 14a, 14a are laterally opened on one of carriers, the swing base 13 or 13B is pivoted downwards and the jaws 14a, 14a of the other carrier 10 are closed. When the swing bases 13 or 13b is pivoted downwards, the clamp head 14 of the carriers 10, 10 are identical in position on the runout table R. This position is coincident with the position in which the metal A is fed from the extrusion machine M.

The position of the clamp head 14 when the swing bases 13 or 13b is pivoted downwards is defined as an operative position. The position of the clamp head 14 when the swing bases 13 or 13B is pivoted upwards is defined as a retracted position. One of the clamp heads 14 in its operative position never interferes with the other clamp head 14 in its retracted position.

The carriers 10, 10 are moved along the entire length of the guide rails G, G forward and rearward by means of a pair of endless wires 16, 16 (FIG. 1). Each wire 16 extends around a pair of pulleys 16a, 16a. The front pulley 16a remote from the extrusion machine M is connected to a drive source 16b such as a hydraulic motor. A hydraulic damper 16c is located adjacent to each pulley 16a to limit movement of the carrier 10. As an alternative, the front pulley 16a connected to the drive source 16b may be in the form of a drum.

A pair of couplers 15a, 16a are provided to limit rearward movement of each carrier 10 and connected to an air source (not shown). When the carrier 10 reaches its rearmost position, the air coupler 15a is automatically coupled to an air coupler 15b of the carrier 10 to replenish the air tank 15. The air tank 15 has enough a volume to control operation at least until the carrier 10 is returned and may include a booster to compensate a decrease in the pressure of air.

Figure 6:
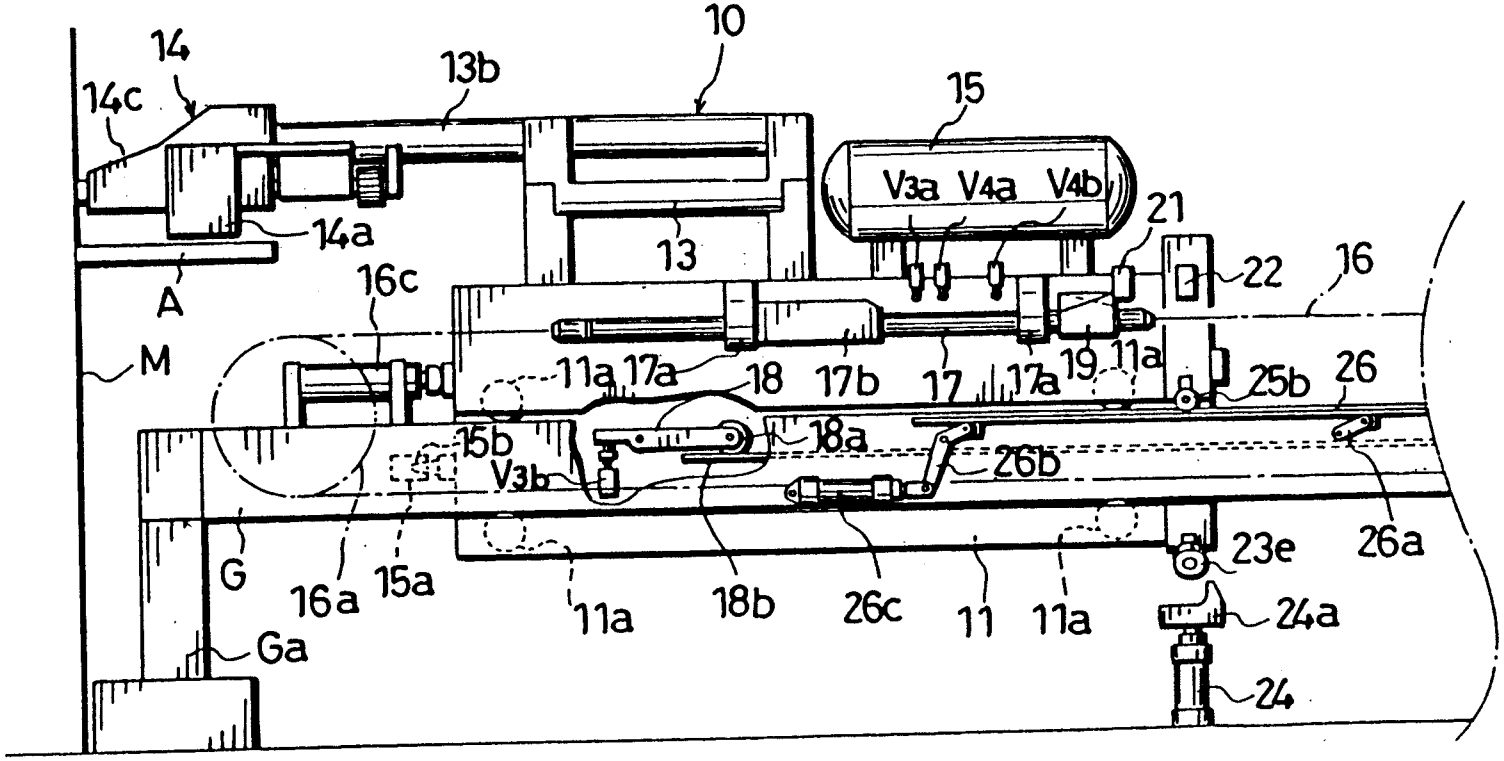
FIG. 6 is a side view showing the manner in which the carrier of FIG. 2 is moved to its rearmost position.

As shown in FIG. 6, the carrier 10 has a slide rod 17 through which opposite ends of the wire 16 is connected to form an endless wire. The slide rod 17 is slidable back and forth through a pair of bearing blocks 17a, 17a. A dog block 17b is secured to the slide rod 17. Movement of the slide rod 17 is limited when the dog block 17b comes into contact with each bearing block 17a.

Figure 7:
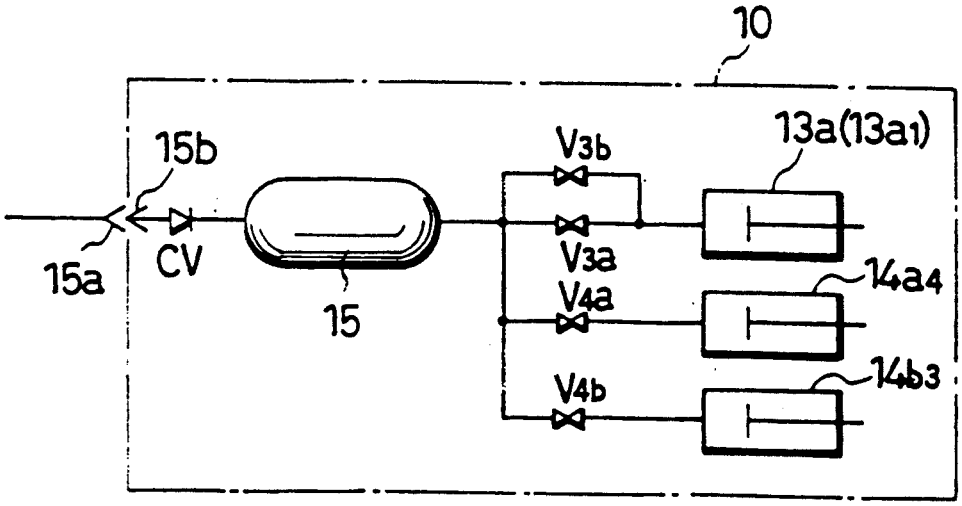
FIG. 7 is a schematic view of an air supply system for use in the carrier shown in FIG. 1.

Three mechanical valves V3a, V4a, V4b are located between the bearing blocks 17a, 17a and are rendered operative as the dog block 17b is advanced. The mechanical valves V3a, V4a, V4b are disposed between the air tank 15 and the air cylinders 13a (or 13a1), 14a4, 14b3 (FIG. 7). When the dog block 17b is advanced to operate the mechanical valves V3a, V4a, V4b, the swing base 13 (or 13B) is pivoted downwards to move the clamp head 14 to its operative position. Then, the jaws 14a, 14a are closed, and the finger 14b is pivoted downwards for clamping the extruded metal A.

As shown in FIG. 7, a check valve CV is disposed between the air couplers 15a, 15b and the air tank 15, another mechanical valve V3b is coupled in parallel to the mechanical valve V3a. And the valve V3b is rendered operative by a swing arm 18 with an associated roller 18a which is mounted to the movable frame 11 (FIG. 6). Specifically, the mechanical valve V3b is rendered operative when the roller 18a of the swing arm 18 is engaged with a control rail 18b. The control rail 18b is attached to the guide rail G adjacent to the extrusion machine M or a position where the rearward movement of the carrier 10 is limited (FIGS. 3 and 6).

Figure 8:
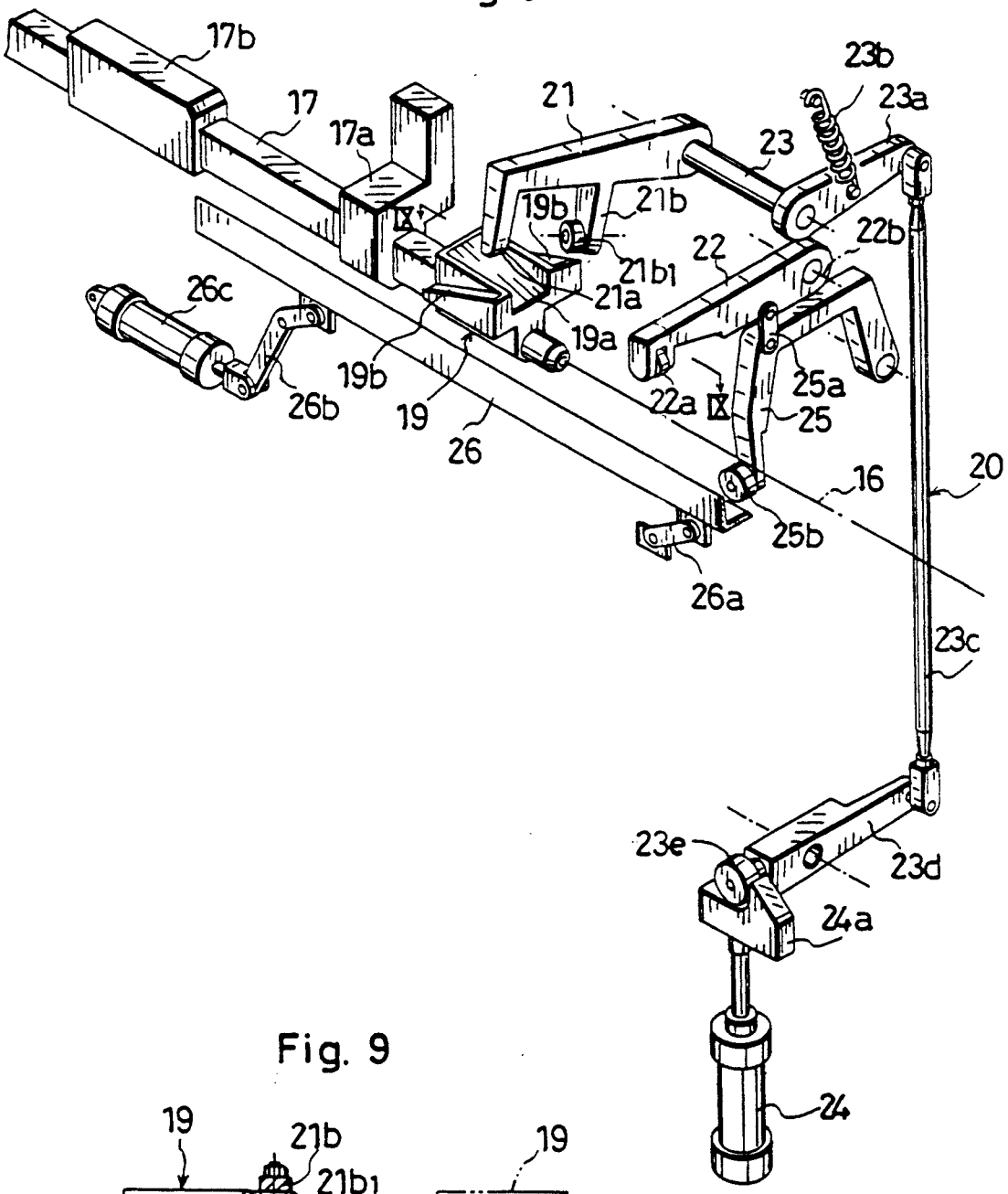
FIG. 8 is a perspective view showing the principal part of the carrier shown in FIG. 1.

As shown in FIG. 8, a control block 19 is secured to the front end of the slide rod 17. The movable frame 11 has a pair of stopper levers 21 and 22 engageable from the upper portion with the control block 19 and cooperative with a control mechanism to limit forward and rearward movements of the slide rod 17. The stopper lever 21 has two arms 21a and 21b, a roller 21b1 is mounted to the arm 21b. Also, a roller 22a is mounted to the front end of the stopper lever 22.

Figure 9:
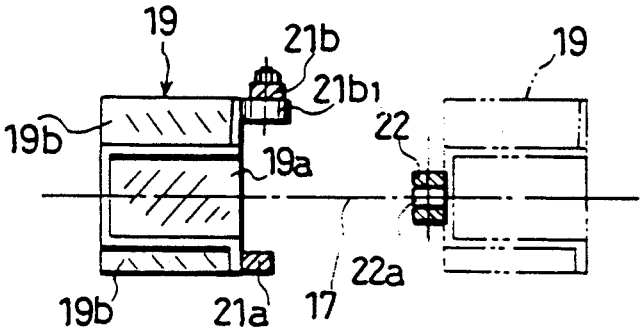
FIG. 9 is a sectional view taken along the line IX—IX of FIG. 8.

The control block 19 has a forwardly inclined central surface 19a, and rearwardly inclined side surfaces 19b, 19b. The arm 21a of the stopper lever 21 and the roller 21b1 of the other arm 21b work together with the inclined surfaces 19b, 19b so as to inhibit forward movement of the control block 19 (shown by a broken line in FIG. 9).

As shown in FIG. 8, a shaft 23 extends from the stopper lever 21. An arm 23a extends from the shaft 23. A spring 23b has one end connected to the arm 23a. Thus, the stopper lever 21 is always urged toward the control block 19. A connecting rod 28c has one end connected to the front end of the arm 23a and the other end connected to one end of a swing arm 23d. A roller 23e is mounted to the other end of the swing arm 23d.

An vertical cylinder 24 (FIGS. 6 and 8) corresponds in position to the roller 23e when the carrier 10 is moved to its rearmost position. The cylinder 24 has a rod, and an engaging element 24ais attached to the rod and adapted to engage with the roller 23e. When the rod is extended, the engaging element 24a is brought into engagement with the roller 23e. This inhibits forward movement of the carrier 10 in its position. Retraction of the rod allows the forward movement of the carrier 10. When the cylinder is extended, the stopper lever 21 is pivoted upwards through the swing arm 23d, the connecting rod 23c, the arm 23a, and the shaft 23. This causes release of the stopper level 21 from the control block 19. When the cylinder 24 is contracted, the stopper lever 21 is brought into engagement with the control block 19 so as to inhibit forward movement of the control block 19.

The stopper lever 22 is pivotable with a shaft 22b and is connected to another swing lever 25 through a connecting piece 25a. A roller 25b is mounted to the front end of swing lever 25.

A movable rail 26 extends substantially along the entire length of the guide rail G (FIGS. 3, 6 and 8). Then roller 25b is lifted in a suitable position of the movable rail 26. The movable rail 26 is vertically translated by a cylinder 26c through a plurality of links 26a. Only one of these links 26a is shown in FIGS. 6 and 8. Extraction and contraction of the cylinder 26c cause vertical translational movement of the movable rail 26. This results in corresponding pivotal movement of the stopper lever 22 to allow and inhibit rearward movement of the control block 19.

Either one of the carriers 10 is moved to a position closest to the extrusion machine, and the other carrier 10 rests in a position corresponding to the length of a metal A to be produced.

When the carrier 10 is moved to its rearward position by the drive source 16b through the wire 16, the slide rod 17 is in its rearmost position as a result of contact between the dog block 17b and the rear bearing block 17a as shown in FIG. 6. At this time, the roller 18a of the swing arm 18 is placed on the control rail 18b to operate the mechanical valve V3*b*, and the mechanical valves V3*a*, V4*a*, V4*b* are rendered inoperative.

When the mechanical valve V3*b* is operated, the swing base 13 (or 13B) is pivoted downwards. The jaws 14a, 14a are laterally opened, and the finger 14b is pivoted upwards. The clamp head 14, although in its operative position, does not clamp the extruded metal. Also, the cylinder 24 is contracted to pivot the stopper lever 21 downwards so as to inhibit forward movement of the control block 19 in its rearmost position. The cylinder 26c is contracted to lower the movable rail 26. The air coupler 15b of the carrier 10 in its rearmost position is automatically coupled to the air coupler 15a. A sufficient amount of air is then supplied to the air tank 15.

Figure 10:
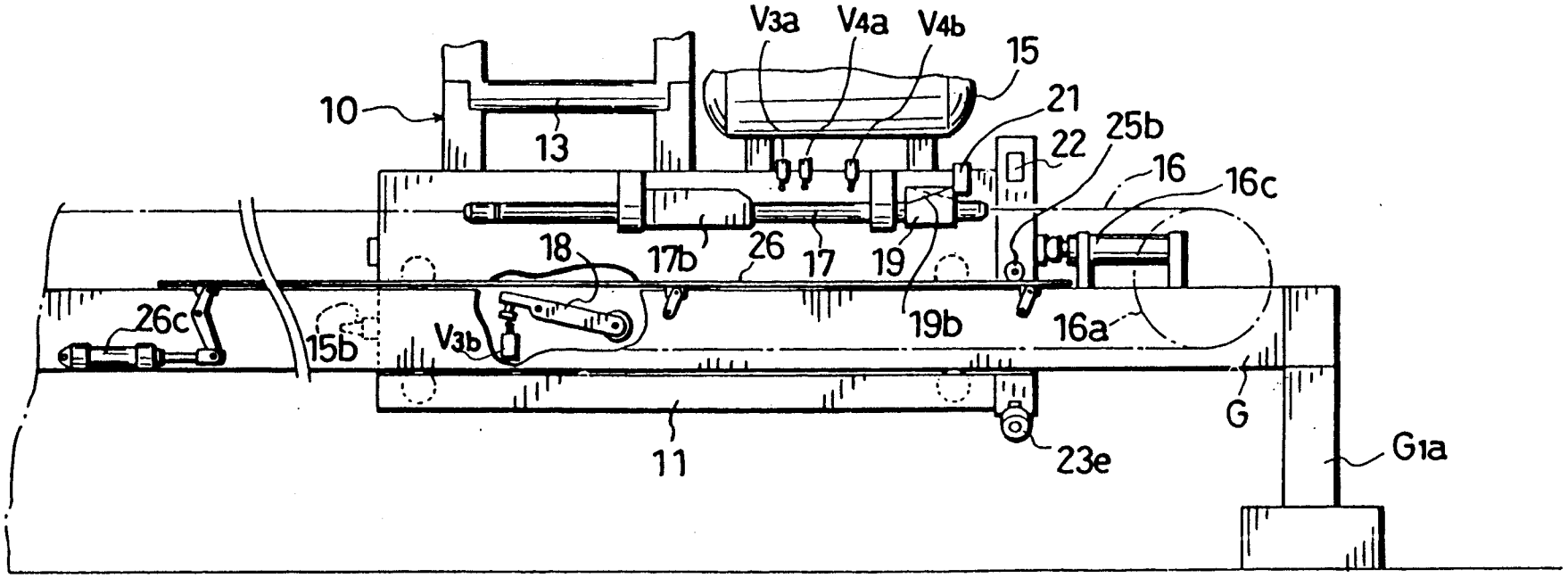
FIG. 10 is a side view showing the manner in which the carrier of FIG. 2 is moved to its foremost position.

In the other carrier in a suitable forward position as shown in FIG. 10, the slide rod 17 is in its rearmost position since the extruded metal A is unclamped. The mechanical valves V3*b*, V4*a*, V4*b* are all rendered inoperative. Thus, the swing arm 13 (or 13B) is pivoted upwards, and the clamp head 14 is in its retracted position. The jaws 14a, 14a are laterally opened, and the finger 14b is pivoted upwards. In order to unclamp the extruded metal A, the cylinder 26c is temporarily extended to lift the movable rail 26 and thus, the stopper lever 22. The cylinder 26c may immediately thereafter be contracted.

Figure 11:
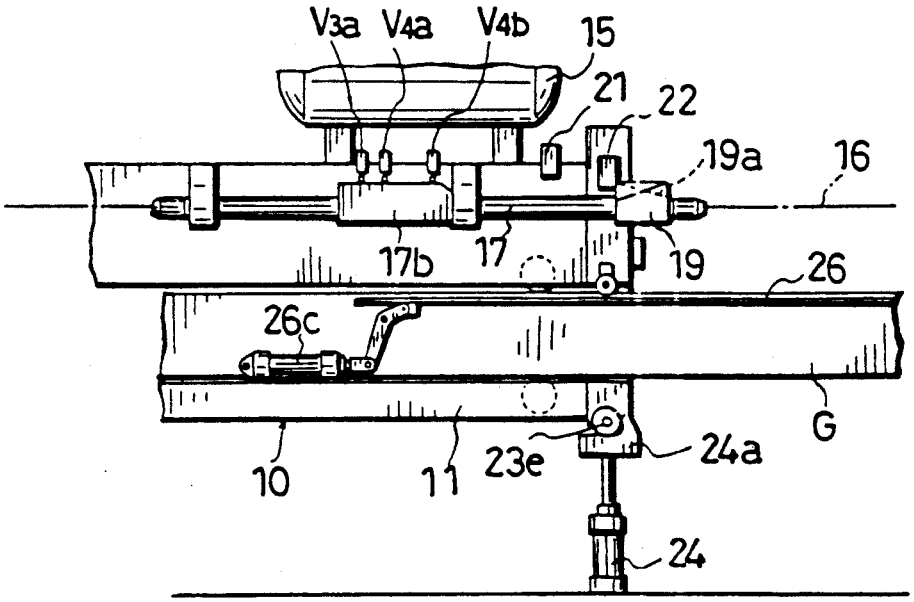
FIG. 11 is a side view showing the manner in which the carrier of FIG. 1 is operated.

As shown in FIG. 11, the cylinder 24 is extended to provide an engagement between the engaging element 24a and the roller 23e so as to inhibit forward movement of the carrier 10. The stopper lever 21 is pivoted upwards to allow forward movement of the control block 19. The drive source 16b then applies a light tractional force to the wire 16. This causes only the slide rod 17 to move in a forward direction, and the carrier is not moved. As a result the mechanical valves V3*a*, V4*a*, V4*b* are rendered operative in this order. The jaws 14a, 14a are closed, and then, the finger 14b is pivoted downwards. This causes the clamp head 14 to clamp the front end of the metal A as fed from the extrusion machine M.

At this time, the control block 19 is moved, through its inclined surface 19a, beyond the stopper lever 22. This prevents rearward movement of the control block 19 (FIG. 11). As the mechanical valve V3*b* is rendered operative by the control rail 18b, the swing base 13 (or 13B) is pivoted downwards to move the clamp head 14 to its operative position.

Figure 12:
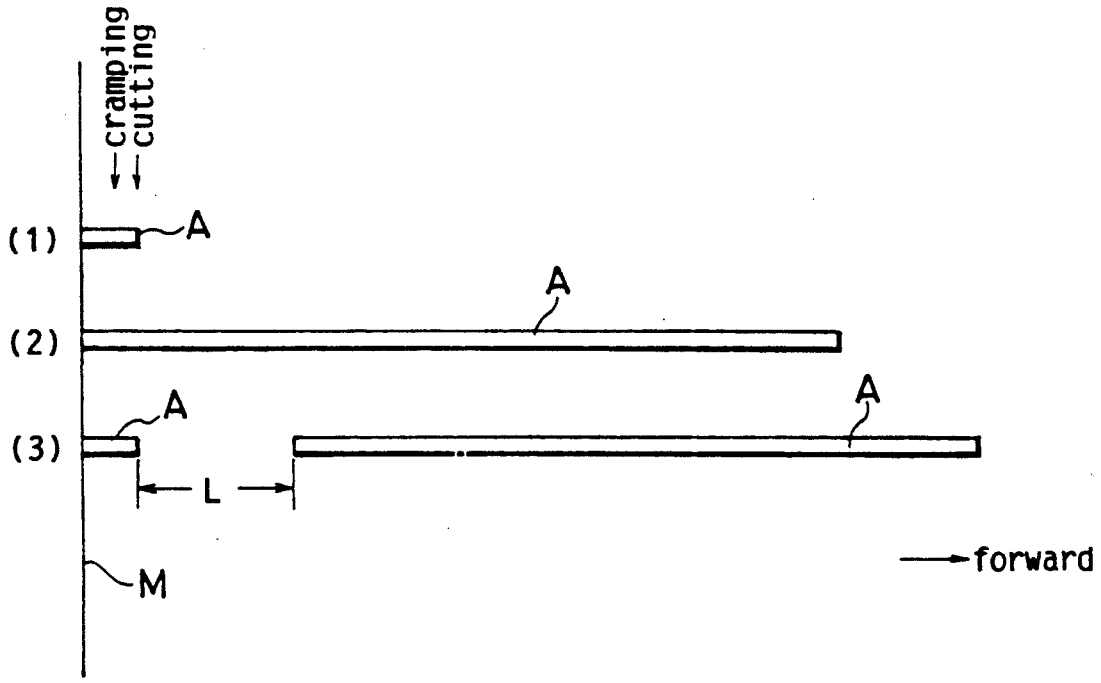
FIG. 12 is a view showing the manner in which an extruded metal is pulled.

Next, the cylinder 24 is contracted to allow forward movement of the carrier 10. A predetermined amount of tractional force is applied from the drive source 16b to the wire 16. When the extrusion machine M is operated, the carrier 10 is advanced at an extrusion speed of the metal A. During an extrusion process, the metal A is pulled constantly by a force identical to the predetermined tractional force exerted on the wire 16 (FIG. 12(2)). When the carrier 10 is advanced, the air coupler 15b is automatically separated from the air coupler 15a. Air pressure is supplied from the air tank 15 to control the operation of the elements on the carrier 10.

When the carrier 10 is moved beyond the entire length of the control rail 18b, the swing arm 18 is returned to render the mechanical valve V3*b* inoperative. However, the mechanical valve V3*a* is already operative to keep the clamp head 14 in its operative position.

When one of the carriers 10 initiates traction of the extruded metal A, the drive source 16b is operated to move the other carrier 10 toward the extrusion machine M through the corresponding wire 16. Although the carriers 10, 10 pass each other in a given position provided that they are separated from the corresponding control rails 18b, they do not interface with one another. This is because the clamp head 14 of the carrier 10 which is active to pull the extruded metal is in its operational position, whereas the clamp head 14 of the other carrier 10 is in its retracted position.

When a predetermined length of the extruded metal A is pulled, the extrusion machine M is temporarily stopped. The base end of the extruded metal A is then cut by a cutter not shown. The carrier 10 which is operating to pull the extruded metal is automatically stopped when the extrusion machine M is stopped. After the extruded metal A has been cut, the carrier 10 is advanced at a constant speed by a predetermined distance L (FIG. 12(3)). This further pulls the extruded metal A.

In the meantime, the other carrier 10 reaches the area of the control rail 18b. The mechanical valve V3*b* then forces the clamp head 14 to its operative position while the carrier 10 is being retracted. In this case, the extruded metal A as pulled does not interfere since the jaws 14a, 14a are opened. The carrier 10 is automatically stopped when it is moved to its rearmost position. The air couplers 15a and 15b are then automatically coupled together so as to replenish the air tank 15 with air.

The drive source is deenergized to stop the carrier 10 which has pulled the extruded metal A by the distance L. The air cylinder 26c is thereafter extended to lift the movable rail 26 (FIG. 10). This causes the stopper lever 22 to pivot upwards to allow rearward movement of the control block 19. The drive source 16b then moves the wire 16 in a rearward direction. This causes the slide rod 17 to move in a rearward direction, The mechanical valves V4*b*, V4*a*, V3*a* are then returned to their inoperative condition in this order. As a result, the finger 14b is pivoted upwards to cause the clamp head 14 to unclamp the extruded metal A. Lateral opening the fingers results in dropping of the front end of the extruded metal A on the runout table R. The swing base 13 is pivoted upwards to move the clamp head 14 to its retracted position. The carrier 10 is returned to its resting position.

When the slide rod 17 is retreated, the control block 19 is moved behind the stopper lever 21 through its inclined surfaces 19*b*, 19*b*. This inhibits forward movement of the control block 19. As the movable rail 26 extends substantially along the entire length of the guide rail G, the extruded metal A can be unclamped without failure by means of the air cylinder 26*c* even if the position in which the carrier 10 is stopped is changed in response to the length of the metal A. As such, required forward movement of the carrier 10 can be minimized.

Next, the other carrier 10 in its rearmost position is similarly operated to pull the extruded metal A. Thereafter, the two carriers 10, 10 are alternately used to substantially continuously produce the metal A.

The extruded metal A as pulled by the carrier 10 and dropped on the runout table R is laterally moved by a transfer mechanism (not shown) in a direction opposite to the guide rails G, G. When the carrier 10 is advanced, the speed of the carriers is limited by the speed at which the metal A is extruded. On the other hand, when the carrier 10 is retracted to pull the next metal A, the carrier 10 can be moved at any speeds by means of the drive source 16*b* and the wire 16.

With the present invention thus far described, a pair of carriers are movable on a corresponding pair of guide rails mounted on one side of the runout table. When the carrier is advanced, the clamp head is in its operative position. When the carrier is retreated, the clamp head is in its retracted position so as not to interfere with the other clamp head in its operative position. Each carrier is moved back and forth on each single guide rail. This enables provision of a simple drive system. Since no subrails are employed, the movement of the carriers can be minimized in accordance with the length of a metal to be pulled. Advantageously, a full open space is available above the runout table to accommodate a cooling fan since no guide rail is placed above the runout table.

We claim:

1. A puller apparatus for an extrusion machine wherein extruded metal fed from an extrusion machine is pulled on a runout table while the metal is clamped by a clamp head, comprising:

a first guide rail and a second guide rail mounted on one side of said runout table and extending in parallel thereto;

a first carrier and a second carrier;

said first carrier being movable on said first guide rail;

said second carrier being movable on said second guide rail;

a first clamp head and a second clamp head;

a first support and a second support;

a first swing base and a second swing base;

said first clamp being mounted to said first carrier through said first support said first swing base;

said said second clamp head being mounted to said second carrier through said second support and said second swing base;

each of said first clamp head and said second clamp head being movable between an operative position and a retracted position;

said first carrier with said first clamp head in its operative position and said second carrier with said second clamp head in its retracted position being constructed so as not to interfere with one another when said first carrier and said second carrier are moved back and forth;

said first carrier with said first clamp head in its retracted position and said second carrier with said second clamp head in its operative position being constructed so as not to interfere with one another when said first carrier and said second carrier are moved back and forth;

said first support having an elongated arm extending over said second carrier;

said second clamp head being attached to said second swing base;

said first swing base and said second swing base being pivotably mounted respectively to a front end of said first support and said second support;

said second carrier including a pair of rod-like supports;

said first clamp head and said second clamp head being attached respectively to said first swing base and said second swing base; and said second swing base being pivotably mounted to ends of said pair of rod-like supports.

2. Apparatus for pulling metal extruded from an extrusion machine, which comprises:

a runout table having a surface;

at least two carriers;

at least two heads for clamping said metal;

each of said at least two heads being mounted to a one of said at least two carriers;

each of said at least two heads being movable between an operative position and a retracted position;

means for guiding said at least two carriers along one side of said runout table and parallel thereto;

said means for guiding being mounted below said surface of said runout table, thereby providing working space thereabove;

said means for guiding being effective to keep a first of said at least two carriers with a first of said at least two heads in said operative position from interfering with a second of said at least two carriers with a second of said at least two heads in said retracted position when said first of said at least two carriers and said second of said at least two carriers are guided back and forth along said runout table.

3. Apparatus for pulling metal extruded from an extrusion machine, which comprises:

a runout table having a surface;

a first guide rail and a second guide rail mounted on one side of said runout table and extending in parallel thereto;

a first guide rail and said second guide rail being mounted below said surface of said runout table, thereby providing working space thereabove;

a first carrier and a second carrier;

said first carrier being movable on said first guide rail;

said second carrier being movable on said second guide rail;

a first clamp head and a second clamp head;

a first support and a second support;

a first swing base and a second swing base;

said first clamp being mounted to said first carrier through said first support said first swing base;

said said second clamp head being mounted to said second carrier through said second support and said second swing base;

each of said first clamp head and said second clamp head being movable between an operative position and a retracted position;

said first carrier with said first clamp head in its operative position and said second carrier with said second clamp head in its retracted position being constructed so as not to interfere with one another when said first carrier and said second carrier are moved back and forth; and said first carrier with said first clamp head in its retracted position and said second carrier with said second clamp head in its operative position being constructed so as not to interfere with one another when said first carrier and said second carrier are moved back and forth;

4. Apparatus for pulling metal extruded from an extrusion machine as in claim 3, wherein:

said first carrier includes a first air tank;

said second carrier includes a second air tank;

said first carrier includes a first plurality of cylinders connected to said first air tank;

said second carrier includes a second plurality of cylinders connected to said second air tank;

said first air tank being connected to a first air coupler for replenishment thereof;

said second air tank being connected to a second air coupler for replenishment thereof; and each of said first plurality of cylinders is actuated by a mechanical valve, whereby said first swing base and said second swing base and said first clamp head and said second clamp head are further actuated.

5. Apparatus for pulling metal extruded from an extrusion machine as in claim 4, wherein:

said first carrier includes a first rod;

said second carrier includes a second rod;

said first rod is slidably mounted;

said second rod is slidably mounted;

said first rod includes a first dog block;

said second rod includes a second dog block;

said first carrier being moved by a first drive wire;

said second carrier being moved by a second drive wire;

said first rod having opposite ends connected to said first drive wire, whereby movement of said first rod causes said first dog block to actuate said plurality of cylinders; and said second rod having opposite ends connected to said second drive wire, whereby movement of said second rod causes said second dog block to actuate said plurality of cylinders.

6. Apparatus for pulling metal extruded from an extrusion machine as in claim 5, wherein:

said first rod includes a first control block;

said second rod includes a second control block;

said first carrier includes a first stop lever and a second stop lever;

said second carrier includes a third stop lever and a fourth stop lever;

said first stop lever and said second stop lever cooperate to limit a range of motion of said first control blocks; and said third stop lever and said fourth stop lever cooperate to limit a range of motion of said second control block.

7. Apparatus for pulling metal extruded from an extrusion machine as in claim 4, wherein:

said first carrier includes a first arm and a first roller;

said second carrier includes a second arm and a second roller;

said first arm and said first roller cooperate to open and close said mechanical valve;

said second arm and said second roller cooperate to open and close said mechanical valve; and said mechanical valve is mounted between a one of said first air tank and said second air tank and a one of said first and second plurality of cylinders.

* * * * *

UNITED STATES PATENT AND TRADEMARK OFFICE

CERTIFICATE OF CORRECTION

PATENT NO. : 5,201,209

DATED : April 13, 1993

INVENTOR(S) : Masao HOUMURA, Mitsuo YASUI, Seizo WASHIZUKA, Norio FUTAKUCHI and Hitoshi MUKAIYAMA It is certified that error appears in the above-indentified patent and that said Letters Patent is hereby corrected as shown below:

On the Title Page, item [73], add --Toyama Light Metal Industry Co., Ltd., Toyama, Japan--

Signed and Sealed this

Twenty-first Day of March, 1995

*Attest:*

Bruce Lehman

BRUCE LEHMAN

*Attesting Officer*

*Commissioner of Patents and Trademarks*